US005881431A

United States Patent [19]

Pieper, II et al.

[11] Patent Number: 5,881,431

[45] Date of Patent: Mar. 16, 1999

[54] DOOR STOP

[76] Inventors: Arthur O. Pieper, II, 22 ½ Church St., Honeoye Falls, N.Y. 14472; William R. Pieper, 321 Mendon Center Rd., Pittsford, N.Y. 14534

[21] Appl. No.: 546,453

[22] Filed: Oct. 20, 1995

[51] Int. Cl.[6] ..... E05D 11/06

[52] U.S. Cl. ..... 16/82; 16/374

[58] Field of Search ..... 16/82, 86 R, 374, 16/377; 292/70, 196

[56] References Cited

U.S. PATENT DOCUMENTS

| | | | |
|---|---|---|---|
| 1,309,748 | 7/1919 | Schroeder | 16/82 |
| 2,280,655 | 4/1942 | Madsen . | |
| 2,586,757 | 2/1952 | Wummel et al. | 16/82 |
| 2,592,230 | 4/1952 | Allen . | |
| 2,799,888 | 7/1957 | White . | |
| 2,993,226 | 7/1961 | Baker | 16/82 |
| 3,187,372 | 6/1965 | Parsons . | |
| 3,913,171 | 10/1975 | Reid . | |
| 3,918,121 | 11/1975 | Williams | 16/82 |
| 4,728,002 | 3/1988 | Shank . | |
| 4,831,688 | 5/1989 | Deininger . | |
| 5,027,471 | 7/1991 | Barnes | 16/86 R |

FOREIGN PATENT DOCUMENTS

| | | | |
|---|---|---|---|
| 628619 | 10/1927 | France | 16/377 |
| 677576 | 3/1930 | France | 16/377 |
| 1193101 | 10/1959 | France | 16/374 |
| 52-63548 | 5/1977 | Japan | 16/385 |
| 2-16277 | 1/1990 | Japan | 16/374 |
| 123074 | 10/1948 | Switzerland | 16/374 |

*Primary Examiner*—Daniel W. Howell
*Assistant Examiner*—Donald M. Gurley
*Attorney, Agent, or Firm*—Cumpston & Shaw

[57] ABSTRACT

The present invention generally relates to devices for limiting the movement of hinged panels such as doors and more particularly to a door stop that can be mounted directly on a door hinge. The door stop comprises a continuous sleeve having a semi-cylindrical inside surface surrounding the hinge barrel and two contact surfaces to engage the hinge plate of a hinge to prevent the door from opening beyond a predetermined angle. Preferably, one contact surface has a greater surface area than the other contact surface. At least one end plate containing a pin aperture is attached to one end of the sleeve. The pin aperture is sized to receive a standard hinge pin shaft therethrough.

2 Claims, 7 Drawing Sheets

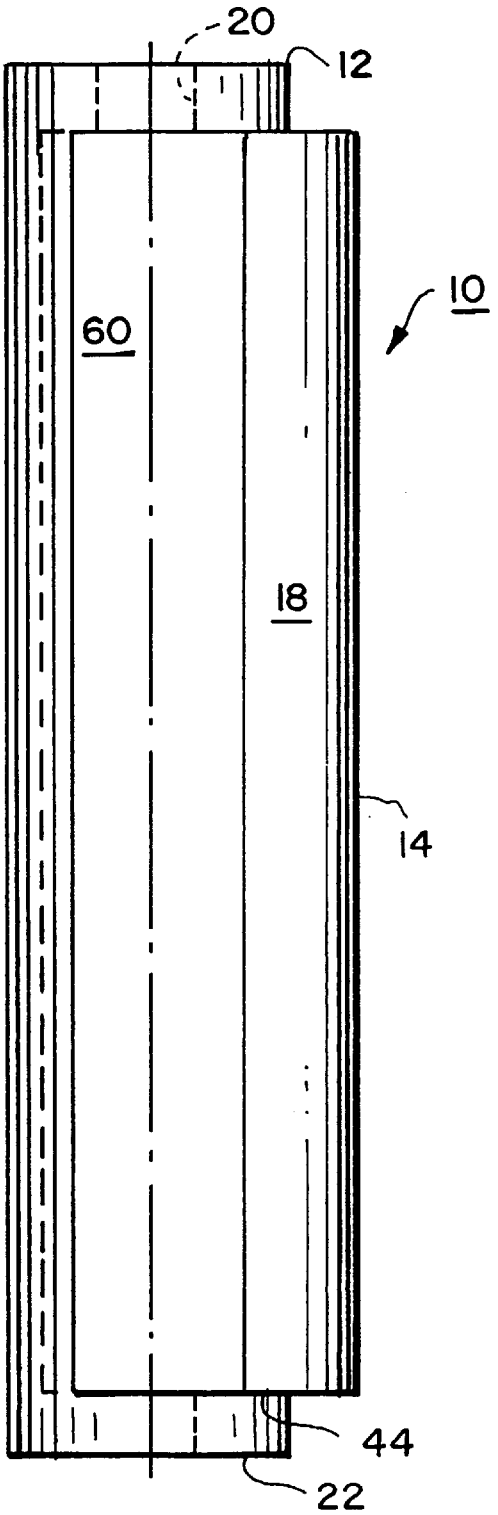
FIG. 5
FIG. 4
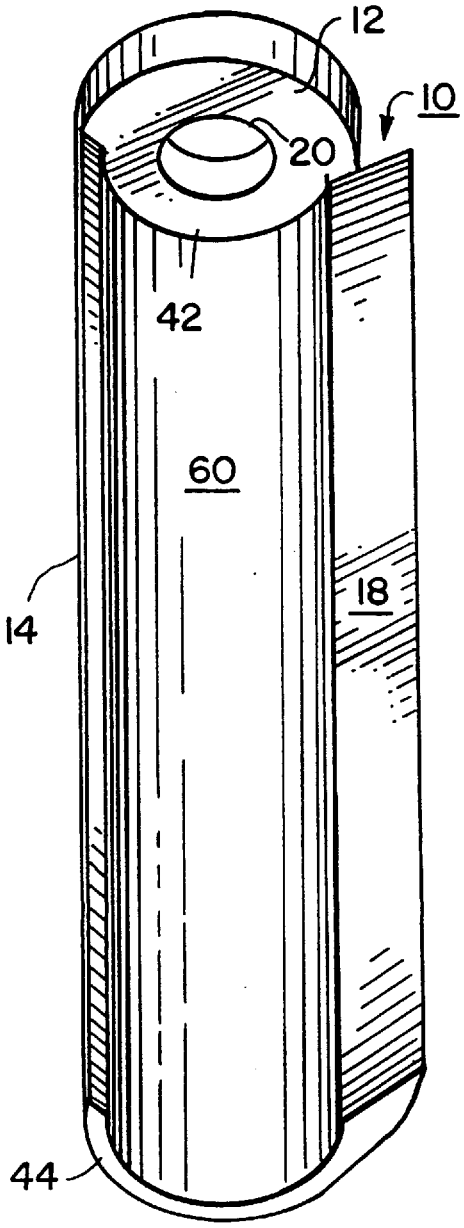

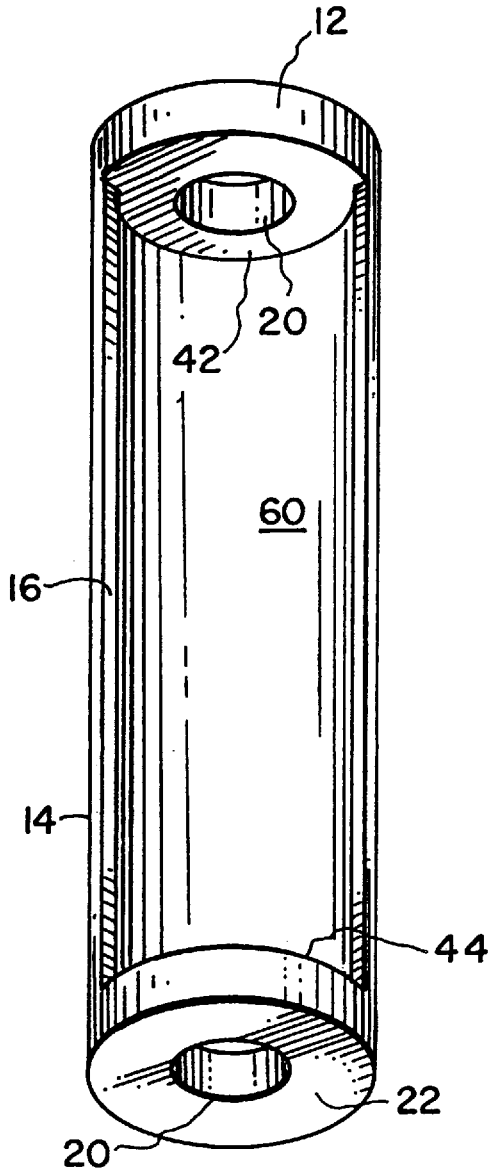
FIG. 6
FIG. 7
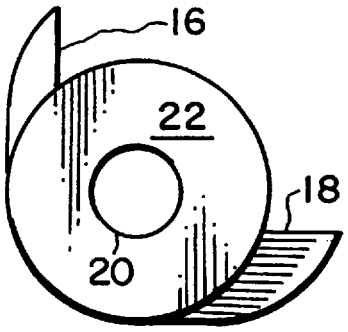

DOOR STOP

FIELD OF THE INVENTION

This invention relates generally to devices for limiting the movement of hinged panels such as doors and more particularly to a hinge mounted door stop utilizing a continuous sleeve having contact surfaces to prevent the door from opening beyond a predetermined angle.

BACKGROUND OF THE INVENTION

Various door stops have been designed throughout the years. These door stops may require permanent attachment to the door, frame, baseboard of a side wall, or hinge plate and/or require the use of tools that many unskilled persons would not be able to use. Further, after a period of use, many door hinges leave dirt, grease, and iron filings on the door and frame. The dirt and iron filings leave the surrounding environment dirty and unattractive.

The present invention of the door stop does not require the use of complex tools to install the device nor does it require permanent attachment to the door, frame, baseboard of a side wall, or hinge plate. The present invention is relatively small, unobtrusive, and will not damage the door or frame. In addition, the present invention allows the user to set the door opening at a predetermined angle.

SUMMARY OF THE INVENTION

The present invention comprises a door stop which is mounted on the hinge of a door. The invention is a door stop for engaging a door hinge having a hinge plate, comprising a continuous sleeve having a semi-cylindrical inside surface for partially surrounding a hinge barrel. The door stop may be manufactured from metal, plastic, polymer, ceramic or any other suitable material. The sleeve includes a first contact surface for contacting a first hinge plate and a second contact surface to engage a second hinge plate. Preferably, the area of the second contact surface is greater than the first contact surface. An end plate with an aperture for receiving a hinge pin is connected to at least one end of the sleeve. The door stop may further comprise a second end plate attached to the second end of the sleeve. The first and second end plates include a pin aperture concentric with each other, sized to receive a hinge pin whereby the hinge pin engages the first and the second end plates. The contact surface or surfaces, which abut the hinge plates, preferably extend beyond the circumference of the end plate or plates. The continuous sleeve will also help prevent dirt, grease, or iron filings from accumulating on the door and the door frame. The unwanted debris and dirt will be contained within the sleeve of the door stop.

An object of this invention is to provide a door stop which is readily mounted in an operational position by the removal and reinsertion of an associated hinge pin.

Another object of this invention is to provide a door stop which allows the door to be opened and set at a predetermined angle.

Still another object of this invention is to provide a door stop which may be utilized on substantially any panel or door hinge.

A further object of this invention is to provide a door stop which will conform to conventional forms of manufacture, be of simple construction, and easy to install so as to provide an apparatus that will be economically feasible, long lasting, and relatively trouble free in operation.

BRIEF DESCRIPTION OF THE DRAWINGS

FIG. 4 is a perspective view of the door stop;

FIG. 5 is a front view of an alternative embodiment wherein the door stop includes two end plates;

FIG. 6 illustrates the bottom view of the door stop where both contact surfaces have approximately the same surface area, namely no thickened edges;

FIG. 7 illustrates the bottom view of the door stop in which both contact surfaces have approximately the same sized thickened edges;

Figure 13:
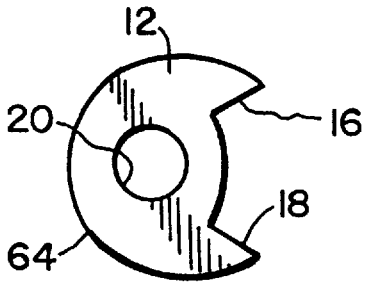
Figure 14:
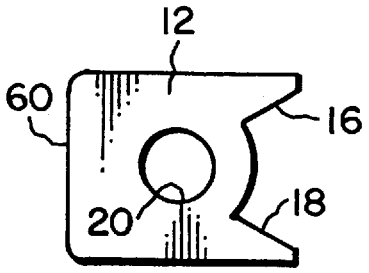
Figure 15:
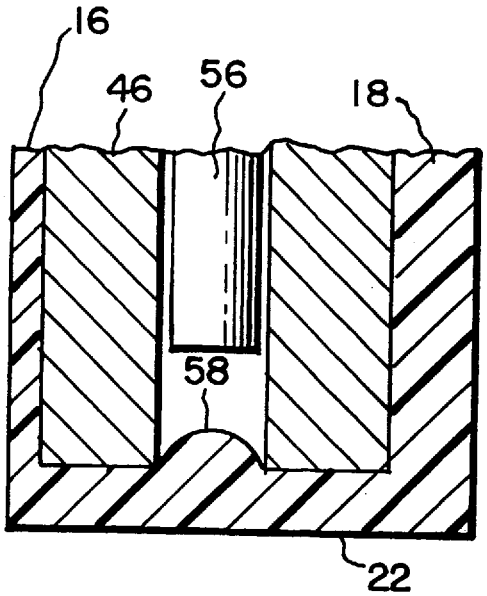

Figures l2 illustrates a door stop having a non-cylindrical tear drop shaped outside surface;

FIG. 13 illustrates a door stop having an oval shaped outside surface;

FIG. 14 illustrates a door stop having a rectangular shaped outside surface; and FIG. 15 is a front view of the door stop having an upwardly extending ridge protruding from the second end plate.

DETAILED DESCRIPTION OF THE INVENTION

Figure 1:
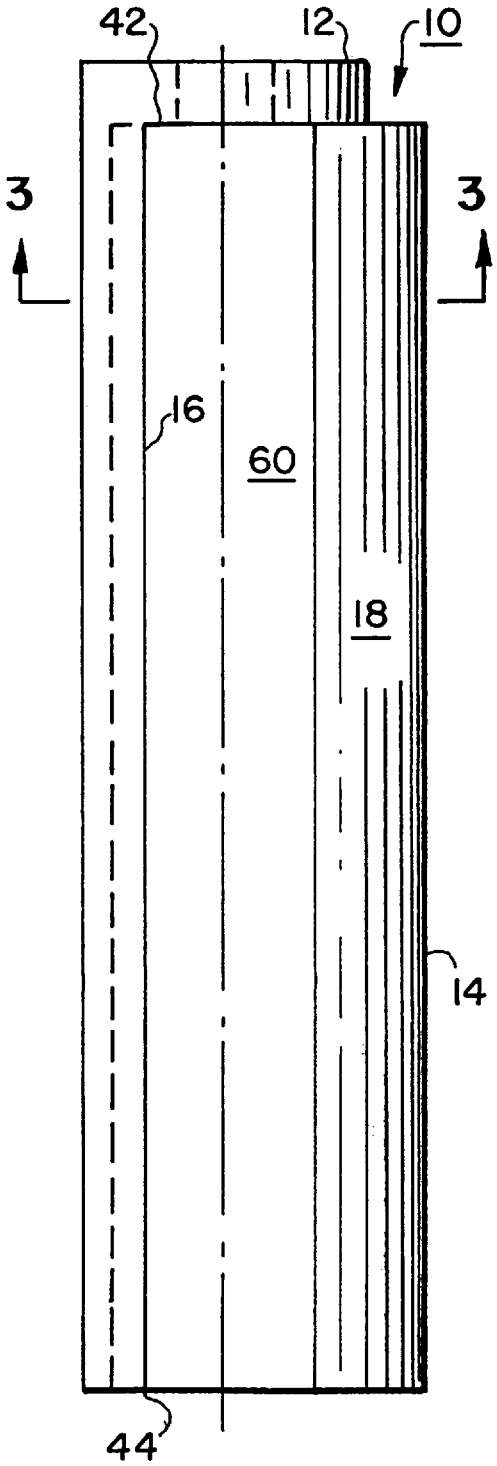
FIG. 1 is a front view of the door stop according to the invention.

Referring to FIG. 1, the door stop 10 comprises a one piece continuous sleeve 14 having a semi-cylindrical inside surface 60, a first contact surface 16, a second contact surface 18, a first end 42 and a second end 44. The second contact surface 18 has a greater surface area than the first contact surface 16. The larger surface area of the second contact surface 18 is adapted to engage a hinge plate and prevent a door from opening beyond a predetermined amount. The door stop 10 also comprises at least one end plate 12 attached to the first end 42 of the semi-cylindrical sleeve 14. The end plate 12 has an aperture 20 formed therethrough to engage a hinge pin shaft.

Figure 2:
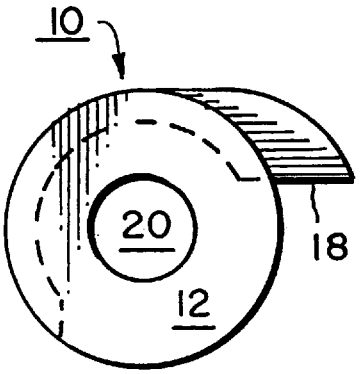
FIG. 2 is a top view of the door stop.

In FIG. 2, a top view of the door stop 10 illustrates the end plate 12 having an aperture 20 to receive a hinge pin shaft. The second contact surface 18, having a large surface area, also referred to as a thickened edge, outwardly projects beyond the circumference of the end plate 12.

Figure 3:
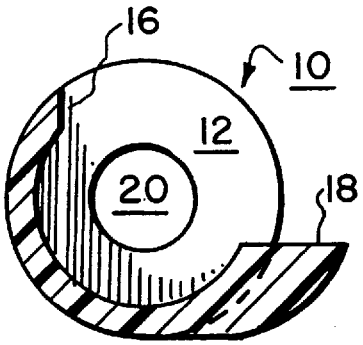
FIG. 3 is a cross sectional view of the door stop taken along sectional line 3—3 of FIG. 1.

FIG. 3 illustrates a cross-sectional view of the door stop taken along the section line 3—3 of FIG. 1. The second contact surface 18 extends beyond the circumference of the end plate 12 while the first contact surface 16 remains within the circumference of the end plate 12.

FIG. 4 illustrates a perspective view of the door stop 10 with the outwardly projecting second contact surface 18 having a thickened edge. The end plate 12, having a pin aperture 20, is attached to the first end 42 of the semi-cylindrical sleeve 14.

The door stop may also have several variations. Both contact surfaces 16 and 18 may have approximately the same surface area, namely no thickened edges, as shown in FIG. 6, while in an alternative embodiment, both contact surfaces 16 and 18 have approximately the same sized thickened edges (see FIG. 7).

FIGS. 5 and 6 show alternative embodiments of the door stop 10. The alternative embodiments have a door stop with two end plates 12 and 22 attached to the first and second ends 42 and 44 of the continuous sleeve 14. The two opposite end plates 12 and 22 have an aperture, concentric with each other, which engages a hinge pin shaft.

Figure 8:
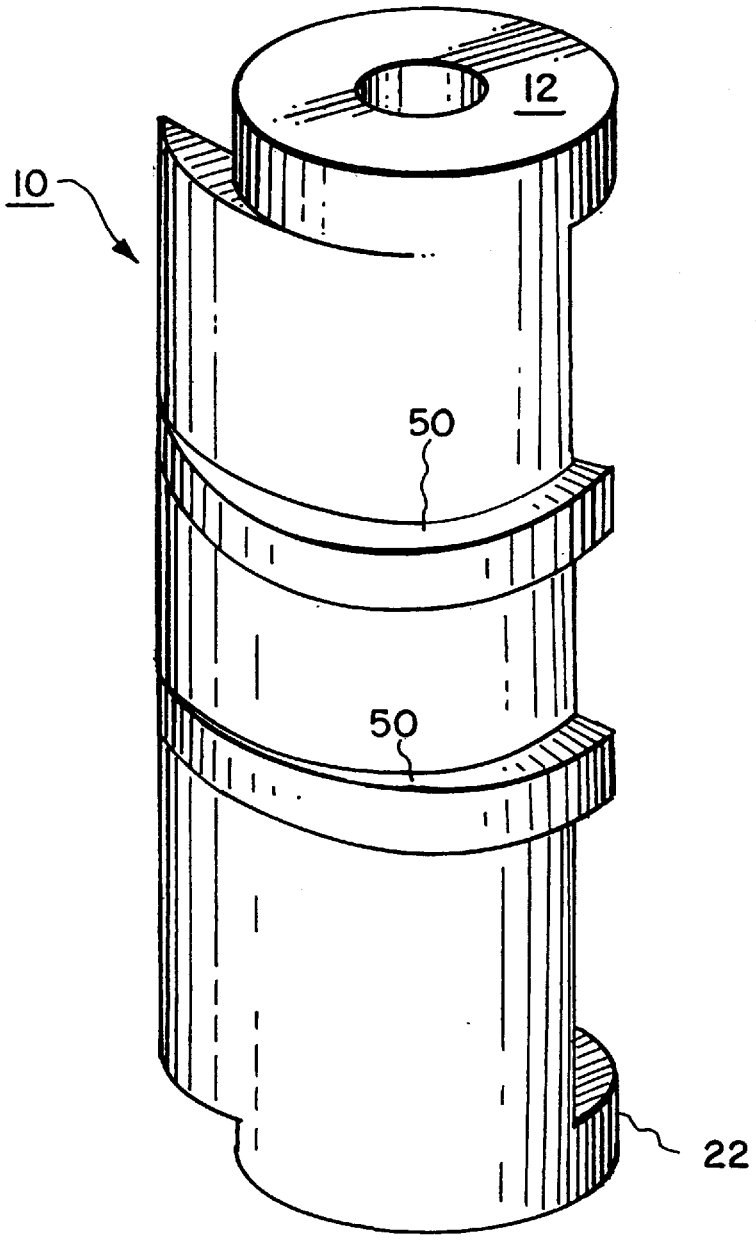
FIG. 8 is a rear view of the door stop with ribs protruding from the sleeve.

In a different embodiment, the sleeve may have an upwardly protruding nipple 58 attached to its' second end plate (FIG. 15). The upwardly protruding nipple 58 may be retained to the bottom of the hinge barrel to keep the sleeve from sliding away from the hinge barrel and to maintain a clean, flush appearance with the hinge barrel. Furthermore, to provide further strength and structural support to the sleeve, one or more reinforcing ribs 50 may extend from the outer surface of the sleeve (see FIG. 8).

Figure 9:
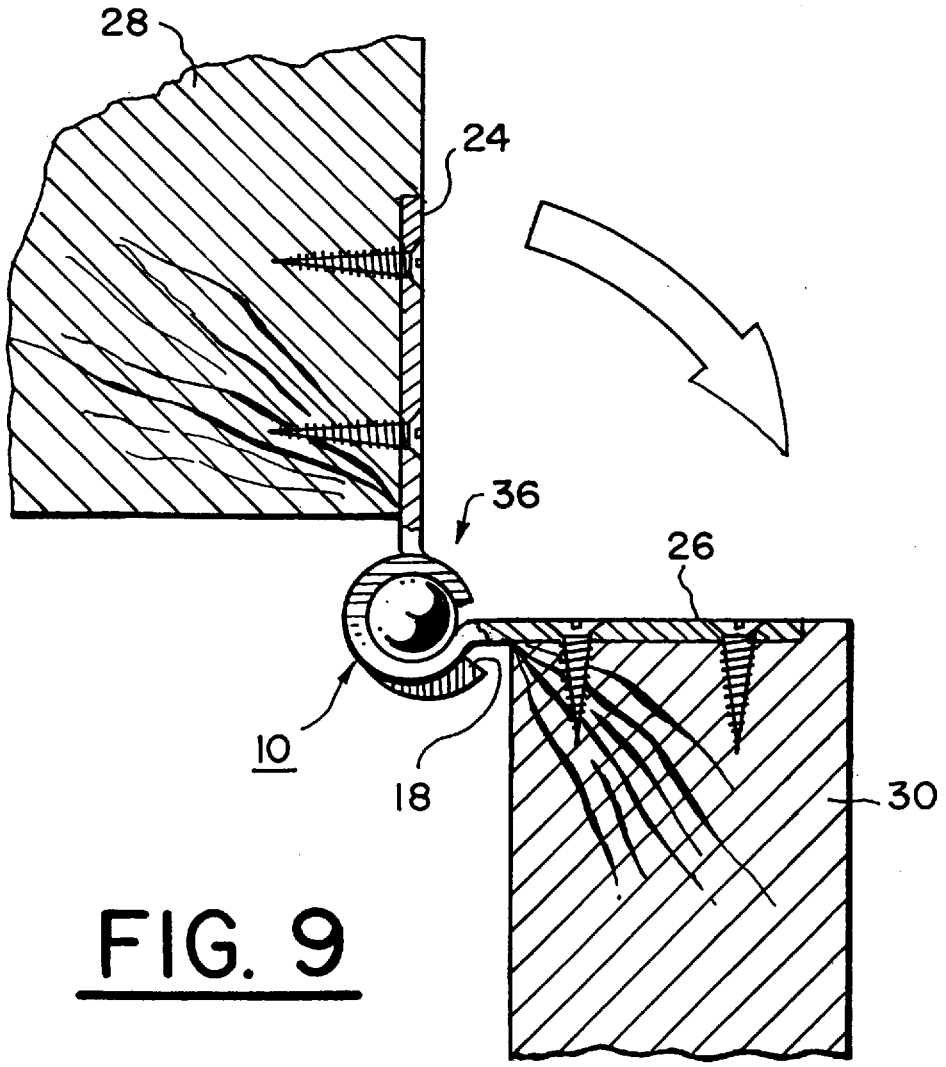
FIG. 9 is a top view of a door frame and hinge with the door stop in an operational position.

FIG. 9 shows the door stop in use on a door hinge. The door stop 10 engages the door hinge. The door hinge includes hinge plates 24 and 26. The door stop 10 works in combination with the hinge construction to limit the range of motion of the door or panel. Hinge plate 26 is attached to the door 30 and hinge plate 24 is attached to the frame 28. The door stop 10 is set in position upon the door hinge 36 and engages the hinge plates 24 and 26. The second contact surface 18 is positioned such that it will engage the hinge plate 26 and not allow door 30 to open beyond a predetermined angle.

Figure 10:
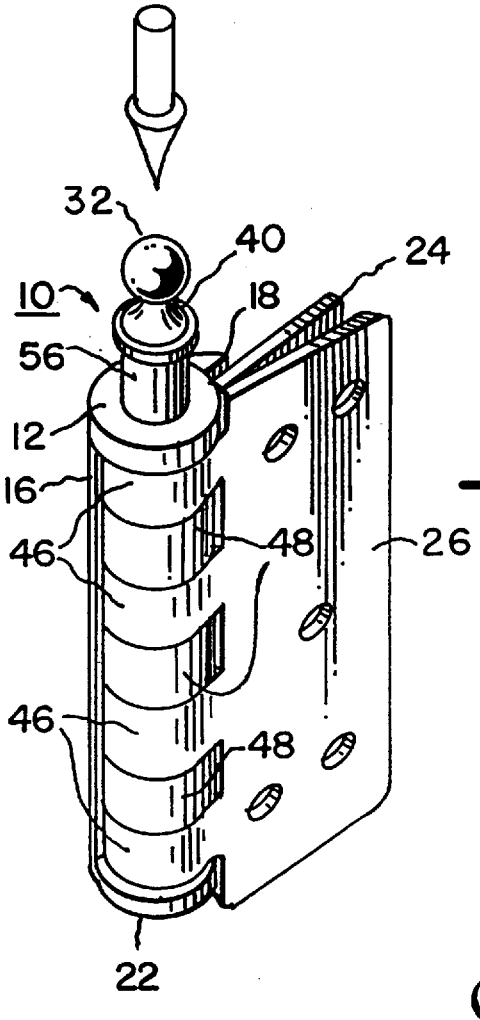
FIG. 10 shows the door stop in an operational position on a hinge.

FIG. 10 shows a side view of the door stop 10 on a door hinge. Hinge plate 26 has a plurality of spaced apart barrel segments 46 attached to one edge. The barrel segments 46 are axially aligned with one another and are interdigitated with the barrel segments 48 of another hinge plate 24 to form a uniform, axially aligned hinge barrel 38. The hinge barrel segments 46 and 48, and thus the hinge barrel 38, have aligned bores for receiving a hinge pin shaft 56. End plate 12 is disposed between the hinge barrel 38 and the crown 40 of the hinge pin 32. The continuous semicylindrical sleeve 14 extends downwardly over the hinge barrel 38. The hinge pin 32 is then axially inserted through the aperture 20 (as shown in FIGS. 1 and 4) and into the hinge barrel 38, thus locking the door stop 10 into position. The door stop may be removed by lifting the axially removable hinge pin from the hinge barrels.

Figure 11:
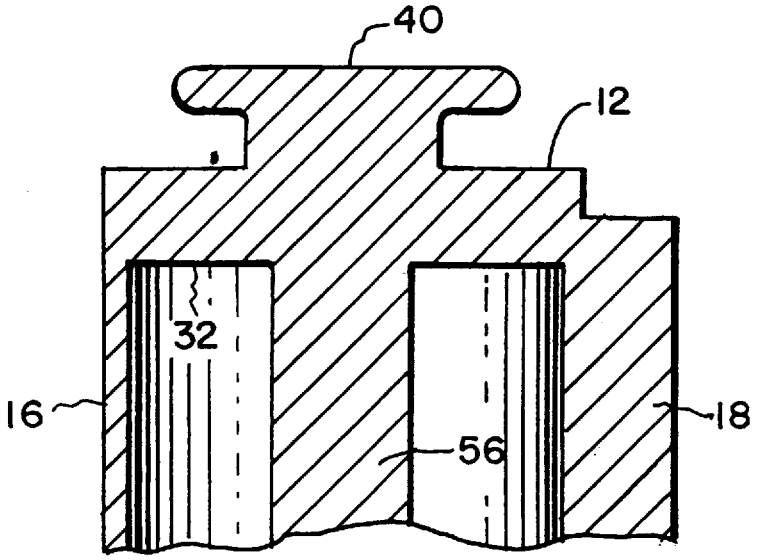
FIG. 11 illustrates a door stop integral with a hinge pin.
Figure 12:
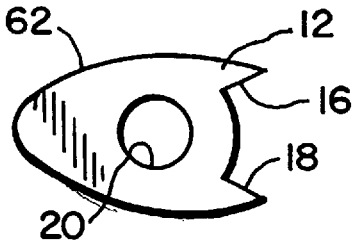

Furthermore, in another alternative embodiment, either end plate 12 or 22 may be fixedly attached to the crown 40 of the hinge pin 32 (FIG. 11). Preferably, the outside surface of the sleeve, as shown in FIGS. 12–14, is not limited to a semi-cylindrical shape. The outside surface of the sleeve may have the shape of a rectangle 60 (FIG. 14), tear drop 62 (FIG. 12), oval 64 (FIG. 13), or any suitable shape. The end plate 12 or end plates 12 and 22 may also be integral with the sleeve 14 such that the end plates 12 and 22 have contact surfaces 16 and 18.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims which scope is to be accorded the broadest interpretation so as to encompass all such modifications and equivalent structures.

I claim:

1. A door stop for engaging a door hinge having a hinge plate and a hinge barrel, comprising:

(a.) a continuous sleeve having a semi-cylindrical inside surface surrounding the hinge barrel, a first end and a second end, the sleeve including a first contact surface for contacting a first hinge plate and a second contact surface to engage a second hinge plate;

(b.) a first end plate connected to the first end of the sleeve, the first end plate including a pin aperture sized to receive a hinge pin; and (c.) a second end plate attached to the second end of the sleeve, and having an upwardly protruding nipple concentric with the pin aperture.

2. A door stop and door hinge having a limited range of motion, comprising:

(a.) a first hinge plate having a plurality of spaced apart barrel segments attached to one edge, the hinge barrel segments having aligned bores for receiving an axially insertable and removable hinge pin therethrough;

(b.) a second hinge plate having a plurality of spaced apart barrel segments attached to one edge such that the barrel segments are axially aligned and interdigitated with the barrel segments of the first hinge plate, forming a uniform, axially aligned hinge barrel, the hinge barrel segments having aligned bores for receiving an axially insertable and removable hinge pin therethrough;

(c.) the hinge pin having a crown and a shaft;

(d.) a sleeve having a semi-cylindrical inside surface surrounding the hinge barrel, a first end and a second end, a first contact surface for contacting the first hinge plate and a second contact surface to engage the second hinge plate;

(e.) an end plate connected to the first end of the sleeve, the end plate including a pin aperture engaging the removable hinge pin; and (f.) a second end plate attached to the second end of the sleeve, the second end plate having an upwardly protruding nipple in axial alignment with the pin aperture.

* * * * *